US005836256A

United States Patent [19]

Senterfeit, Sr.

[11] Patent Number: 5,836,256

[45] Date of Patent: Nov. 17, 1998

[54] APPARATUS FOR MOVING AUTOMATIC TELLER MACHINES BETWEEN RETRACTED AND EXTENDED POSITIONS

[75] Inventor: Kenneth G. Senterfeit, Sr., West Columbia, S.C.

[73] Assignee: Concept Unlimited Inc, Gaston, S.C.

[21] Appl. No.: 887,012

[22] Filed: Jul. 2, 1997

[51] Int. Cl.[6] ..... G07G 5/00

[52] U.S. Cl. ..... 109/24.1; 109/47; 109/2; 312/319.7; 902/30

[58] Field of Search ..... 109/24.1, 50, 45, 109/47, 48, 2; 414/277, 282, 749; 312/334.24, 334.25, 334.27, 331, 319.5, 319.7, 350; 902/30–35

[56] References Cited

U.S. PATENT DOCUMENTS

| | | | |
|---|---|---|---|
| 3,028,209 | 4/1962 | Hinkel et al. | 312/319.7 |
| 4,235,491 | 11/1980 | Korber et al. . | |
| 4,399,755 | 8/1983 | Wiedmann . | |
| 4,457,492 | 7/1984 | Lahti . | |
| 4,497,261 | 2/1985 | Ferris et al. . | |
| 4,513,670 | 4/1985 | Berman . | |
| 4,557,352 | 12/1985 | Tschappat, Jr. . | |
| 4,558,650 | 12/1985 | Berman . | |
| 4,569,294 | 2/1986 | Beattie et al. . | |
| 4,577,562 | 3/1986 | Berman . | |
| 4,603,643 | 8/1986 | Couvrette . | |
| 4,649,832 | 3/1987 | Hain et al. . | |
| 4,681,044 | 7/1987 | Dallman . | |
| 4,796,515 | 1/1989 | Dry . | |
| 4,813,475 | 3/1989 | Couvrette . | |
| 4,820,109 | 4/1989 | Witt | 414/282 |
| 4,856,437 | 8/1989 | Trucksess . | |
| 5,035,171 | 7/1991 | Gottling et al. . | |
| 5,036,779 | 8/1991 | Capraro . | |
| 5,144,883 | 9/1992 | Muller et al. . | |
| 5,215,363 | 6/1993 | Warwick, III . | |
| 5,222,445 | 6/1993 | Capraro . | |
| 5,299,511 | 4/1994 | Dallman et al. . | |
| 5,440,999 | 8/1995 | Dallman et al. . | |

FOREIGN PATENT DOCUMENTS

| | | | |
|---|---|---|---|
| 283275 | 4/1915 | Germany | 109/47 |
| 207665 | 2/1966 | Sweden | 312/331 |

*Primary Examiner*—Darnell M. Boucher
*Attorney, Agent, or Firm*—Michael A. Mann

[57] ABSTRACT

Apparatus is disclosed for moving an automatic teller machine and the like between a retracted position and an extended position to provide access to the back of the machine for servicing. The apparatus essentially comprises a stationary frame and a moving carriage supported by the frame. In the retracted position, the front end of the carriage is coextensive with the front end of the frame. In the extended position, however, the front end of the carriage is cantilevered beyond the front end of the frame. In order to move and support the carriage, especially in the extended position, there is a shaft freely rotatable in a pair of bearings at the front end of the frame on which the carriage rides. The back end of the carriage rides within the frame's rails, which prevent the carriage from moving up or down but otherwise freely allows lateral movement. By turning the shaft with a hand crank or a small motor, the carriage with the teller machine can easily be moved between retracted to extended positions.

20 Claims, 5 Drawing Sheets

44
30
32
42
46
46
40
22

48
44
30
32
42
52
40
22

22
54
40
34
62
42
58
56
64
32
24
30

APPARATUS FOR MOVING AUTOMATIC TELLER MACHINES BETWEEN RETRACTED AND EXTENDED POSITIONS

BACKGROUND OF THE INVENTION

1. Field of the Invention

The present invention relates generally to kiosks housing automatic teller machines (ATMs). In particular, the present invention relates to a mechanism for moving the ATM out of the kiosk to provide access to the back of the ATM for servicing.

2. Discussion of Background

Automatic teller machines (ATMs) and, more recently, automatic loan machines (ALMs), have made it more convenient for consumers to take care of their routine banking needs. ATMs are frequently housed in small buildings, or "kiosks" that have drive-through lanes next to them. The consumer drives up to the kiosk to operate the ATM. Consumers may obtain cash, make deposits, check on balances, obtain a consumer loan, etc.

These ATMs must be serviced periodically, which includes reloading them with cash, retrieving the deposits, changing printer ribbons, and routine maintenance and repair. Servicing of the ATMs is complicated by the orientation of the ATM with respect to the kiosk. Because the kiosks are narrow, typically occupying an "island" between drive-through banking lanes, and because the ATMs are positioned to be operated by users from a long side, the back of the ATM inside the kiosk is against the opposing long side wall. Servicing the ATM is done inside the kiosk, partly for security and partly to avoid tying up the next lane to the rear of the kiosk. Servicing also requires gaining access to the back of the ATM from inside the kiosk. Consequently, servicing an ATM requires either that it be moved through a hole in the wall of the kiosk to make room behind it in the kiosk, or that it be rotated to turn its back to someone standing beside the ATM and in the kiosk. The ATM is a heavy piece of equipment, typically weighing several thousand pounds. Consequently, a number of systems have been designed to move it more easily. These are generally referred to as transport systems.

For example, the transport systems described by Dallman et al. in U.S. Pat. No. 5,440,999 include several approaches to moving an ATM between extended and retracted positions, including two designs based on the use of cable. The cable systems are complicated and involve multiple cables and pulleys. Another of the designs uses a rack and pinion arrangement.

Many devices for moving an ATM have separate devices for the support of the ATM and the mechanism to move it. Specifically, the typical design will provide a base and a carriage that is slidable or movable with respect to the base and then add a separate mechanism for moving one with respect to the other. This approach inherently complicates the design.

Consequently, there remains a need for an ATM transport system that is simple to operate, durable, effective, and easily manufactured.

SUMMARY OF THE INVENTION

According to its major aspects and broadly stated, the present invention is an apparatus for moving an automatic teller machine (ATM) and the like between a retracted position inside a kiosk and an extended position, where the ATM extends through an opening in the wall of the kiosk so that the back of the ATM can be serviced from inside the kiosk. The apparatus in its essential embodiment comprises a stationary frame and a moving carriage supported by the frame. In the retracted position, the front end of the carriage is coextensive with the front end of the frame and both are inside the kiosk. In the extended position, however, the front end of the carriage is cantilevered beyond the front end of the frame. In order to move and support the carriage, especially in the extended position, there is a shaft held by bearings attached to the front end of the frame. The shaft rotates freely in the bearings and the carriage rides directly on the shaft. The back end of the carriage rides within the frame's rails to prevent the carriage from moving up or down but otherwise freely allows lateral movement. By turning the shaft with a hand crank or a small motor, the carriage with the teller machine resting on it can easily be moved between retracted to extended positions.

An advantage of the present invention is its simplicity. The ATM can be moved easily using a simple handcrank. Therefore, there are no sprockets, no pulleys, no chains, and no complicated arrangements of moving parts to require service and repair. Furthermore, in the event of an electricity failure, the ATM can still be serviced or retracted into the kiosk. Because ATMs are serviced daily and have useful lives that span several years, reliability of operation is an important consideration.

An important feature of the present invention is the rotating shaft. Not only does it support the ATM, via the carriage, but it moves it between the extended position and retracted position. The use of a simple, sturdy shaft to roll the ATM between its extreme positions greatly simplifes the design by combining support and moving mechanisms in one structure.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
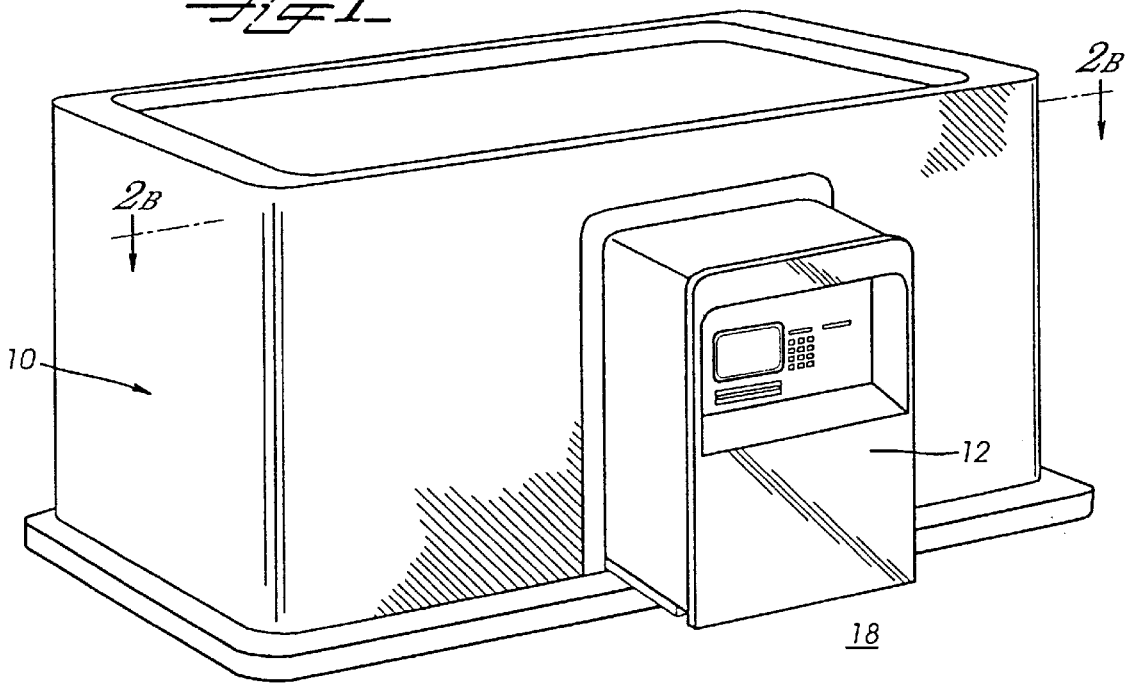
FIG. 1 illustrates in perspective a kiosk having an antomatic teller machine where the ATM is in the extended position.
Figure 2A:
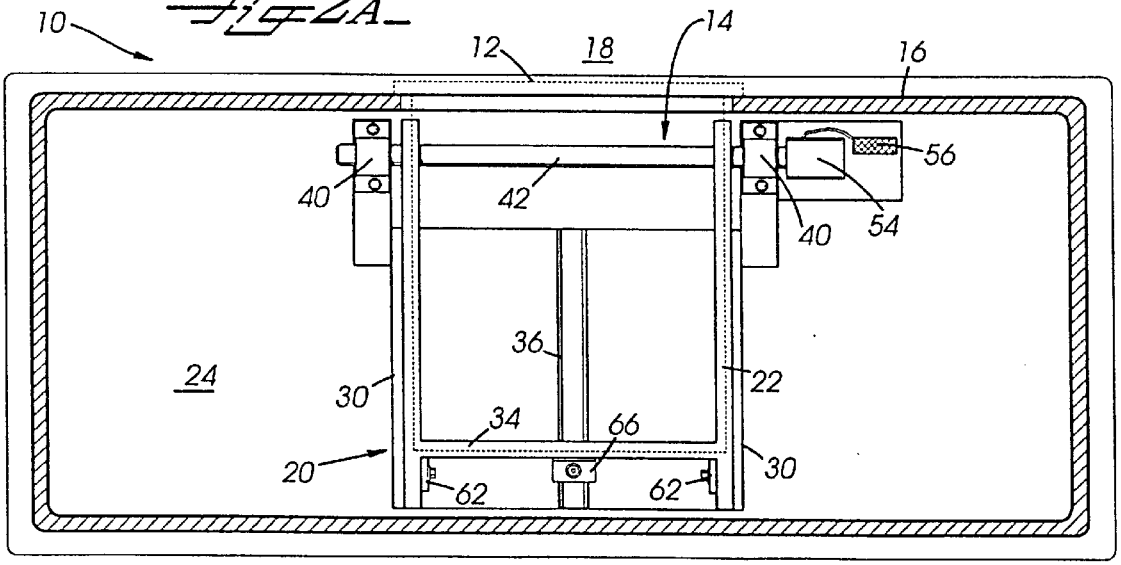
FIG. 2A illustrates the top view of FIG. 2A with the ATM in the retracted position.
Figure 2B:
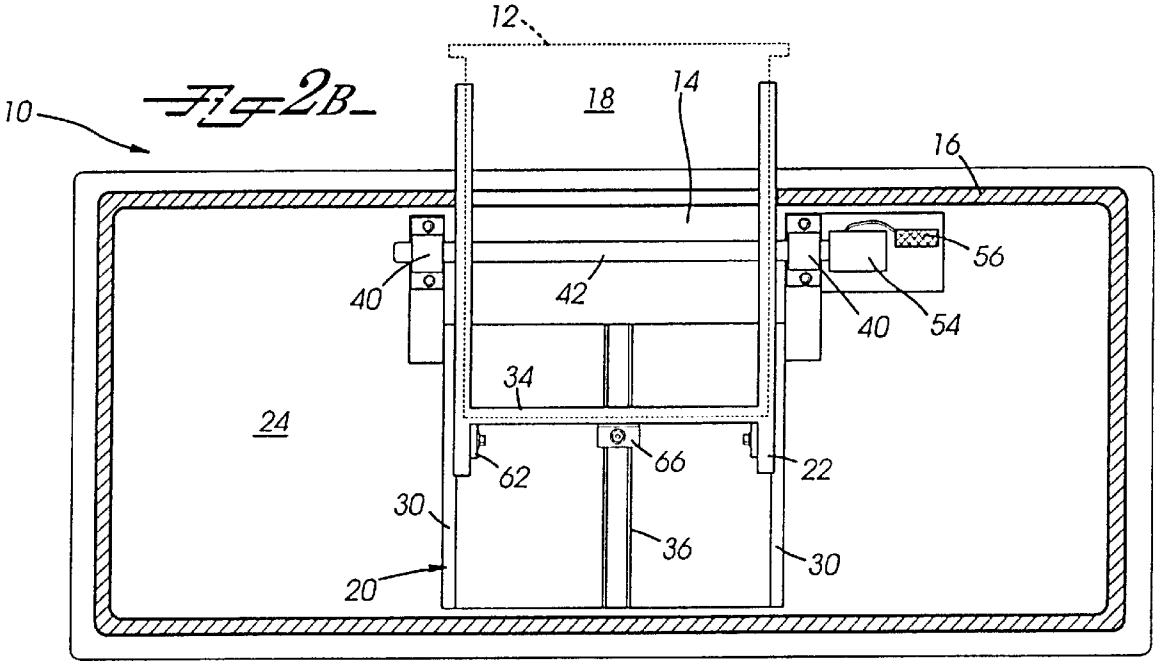
FIG. 2B illustrates a top view of a kiosk as shown in FIG. 1 and taken along lines 2—2.
Figure 3:
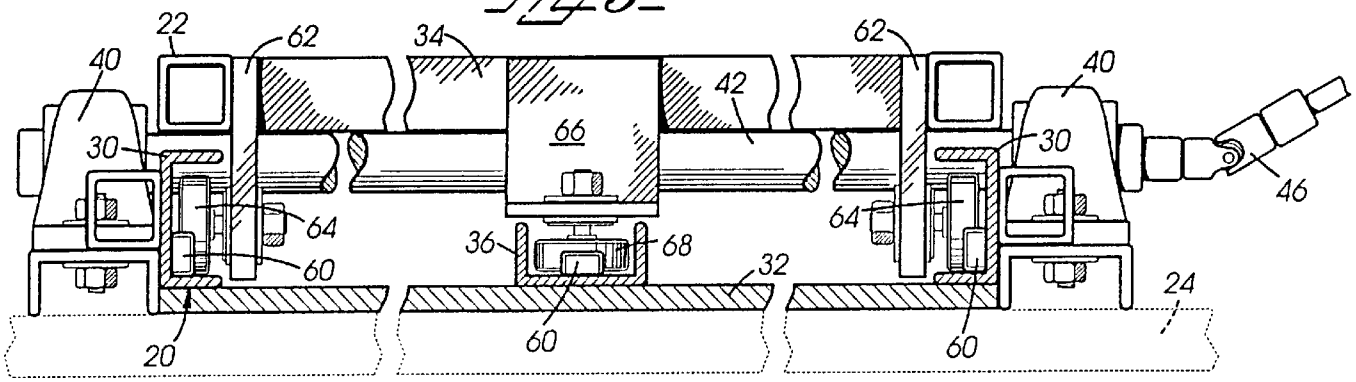
FIG. 3 is a rear view of the transport mechanism according to a preferred embodiment of the present invention.
Figure 4A:
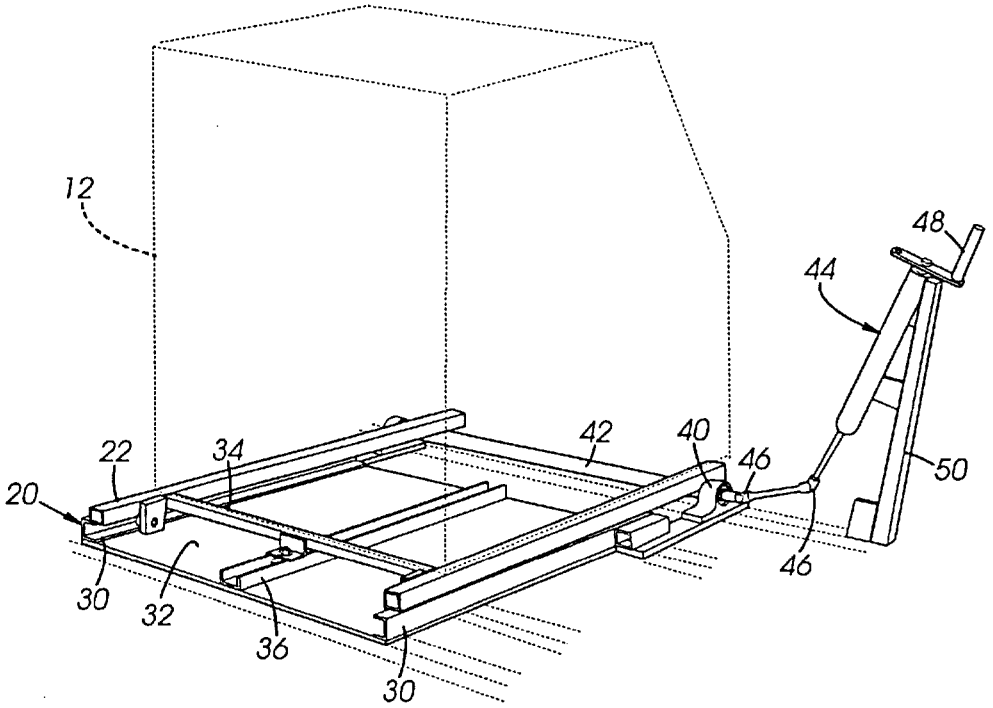
FIGS. 4A and 4B are perspective views of the transport apparatus according to a preferred embodiment of the present invention, showing the transport apparatus in the retracted and extended positions, respectively.
Figure 4B:
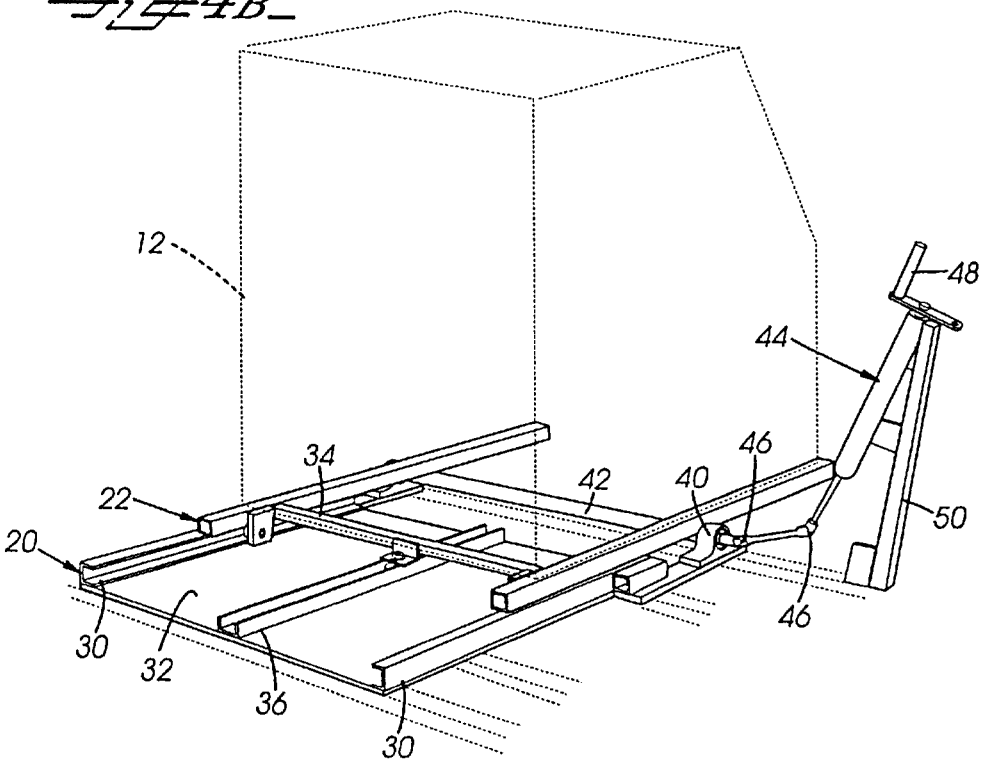

Referring now to FIGS. 1, 2A and 2B, the present invention is an apparatus for moving an automatic teller machine (ATM) 12 in a kiosk 10, or the like, between its retracted position and its extended position. ATM 12 must be serviced from the back. When it is housed in kiosk 10, where space in kiosk 10 behind ATM 12 is limited, the only ways to service ATM 12 are to rotate it, move the rear wall of kiosk 10 away from the back of ATM 12, or move it through an opening 14 in the wall 16 of kiosk 10. The choice of these that is the simplest and has the least impact on banking operations is to move ATM 12 to an extended position, as illustrated in FIGS. 1 and 2B, from the retracted position shown in FIG. 2A. In the extended position, ATM 12 is cantilevered out of kiosk 10 into a drive-through area 18 so that an attendant can gain access to the back of ATM 12 in order to service it.

Referring to FIGS. 2–5, the present apparatus includes a stationary frame 20 and a movable carriage 22. Frame 20 is fixed with respect to the floor 24 of kiosk 10; carriage 22 rests on top of frame 20 and is supported by it in both the retracted position and extended position, where carriage 22 is cantilevered over the drive-through area 18 next to kiosk 10. By cantilevered, it is meant that neither ATM 12 nor the front end of carriage 22 on which ATM 12 rides touch the surface of drive-through 18 but are held above it by the support and securement provided by the back end of carriage 22.

The "front end" of kiosk 10 is so designated for the purposes of the explanation of this invention as being the side from which traffic approaches to make use of ATM 12, the same side as drive-through 18. The "back end" of kiosk 10 is the opposing side. Correspondingly, the "front end" of ATM 12, carriage 22 and frame 20 are all on the same side, and the opposing side will be referred to as the back end of ATM 12, carriage 22 and frame 20, respectively.

In the retracted position (FIGS. 2A and 4A), the front ends of carriage 22 and frame 20 are coextensive, that is, the front end of carriage 22 is located approximately overhead of the front end of frame 20, both being just inside wall 16 of kiosk 10. In other words, coextensive means that the front end of the carriage 22 does not extend significantly farther forward, if at all, beyond the front end of frame 20. In the extended position (FIGS. 2B and 4B), the front end of carriage 22 has moved forward through opening 14 in wall 16 of kiosk 10 and the back end of carriage 22 has moved forward toward the front end of frame 20.

Frame 20 comprises at least one rail and preferably at least two side rails 30, one on the left side of frame 20 and one on the right side of frame 30, as well as means for holding two side rails 30 parallel to each other. Side rails 30 may simply be fashioned from channel steel. As illustrated in FIGS. 2A, 2B, 3, 4A and 4B, a sheet 32 of steel can be used conveniently to hold side rails 30 in parallel relationship. Alternatively, side rails 30 can be set in cement or attached to a member 34 perpendicular to side rails 30.

Optionally, a central rail 36, also preferably made of channel steel, is provided for lateral stability in moving ATM 12 between retracted and extended positions. Central rail 36 is located between side rails 30 but not necessarily midway between them. Preferably, central rail 36 is located more toward one side rail 30, so that the area just above carriage 22 can be covered with a suitable flooring for the attendant servicing the ATM to stand on.

Mounted toward the front end of frame 20 are bearings 40. A shaft 42 is journaled in bearings 40 so as to rotate freely therein. One end of shaft 42 is coupled to means for rotating the shaft, such as, for example, the hand crank 44 shown in FIGS. 3A, 3B and 4. The end of shaft 42 is coupled using at least one U-joint 46, preferably at least two for smooth operation and so that the axis of rotation is shifted from horizontal to nearly vertical for the convenience of the attendant who will rotate the handle 48 of the hand crank 46. Hand crank 46 is held in place by a suitable support 50.

Figure 6:
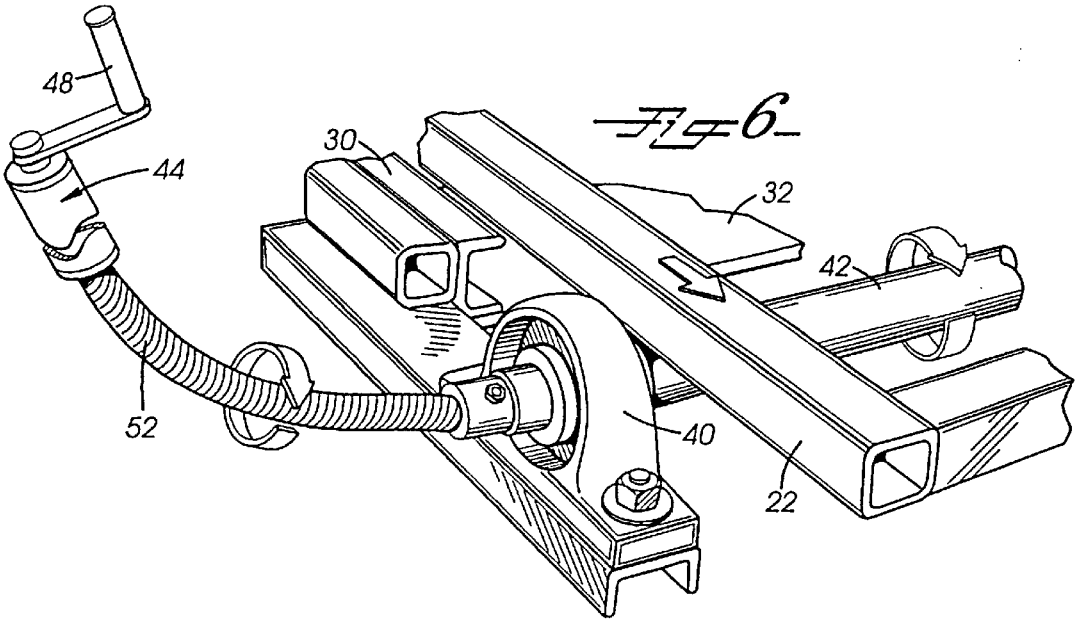
FIG. 6 is a perspective view of another shaft-turning mechanism according to a preferred embodiment of the present invention.
Figure 7:
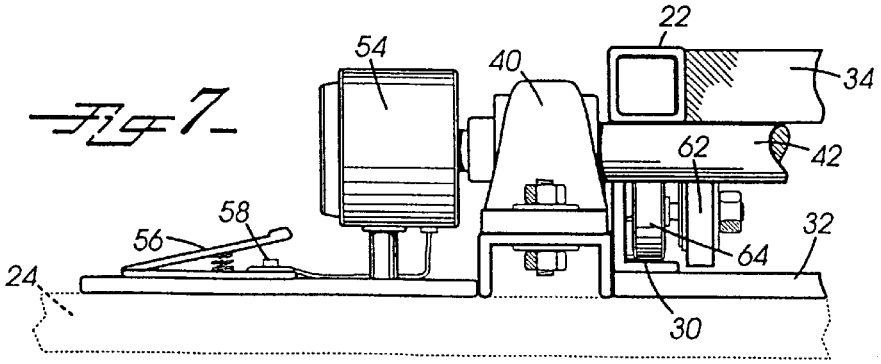
FIG. 7 is a perspective view of still another shaft-turning mechanism according to a preferred embodiment of the present invention.

Alternately, a flexible coupling 52 can be employed instead, as shown in FIG. 6, and hand crank 44 can be replaced by an electric motor 54, as shown in FIG. 7, operated perhaps by a foot control 56 that reverses direction each time the foot of the attendant is applied to press a switch 58.

Figure 8:
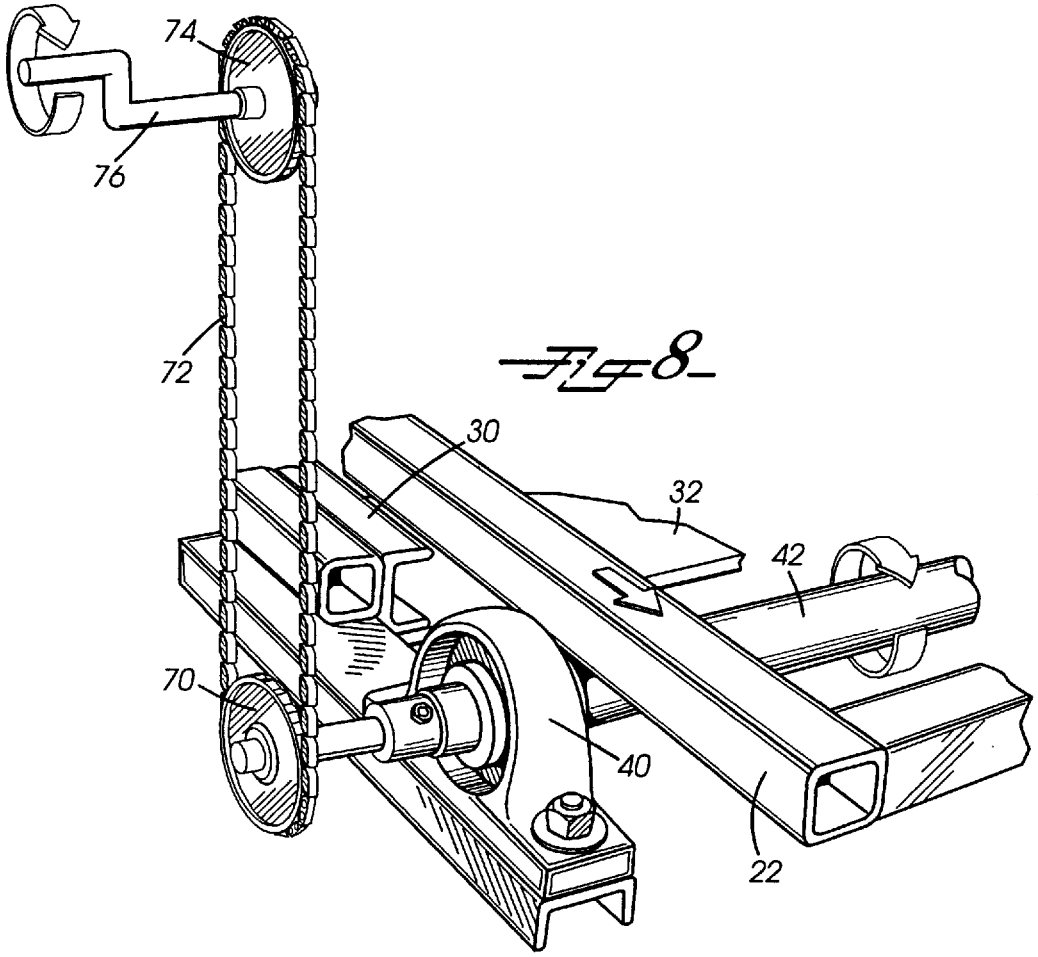
FIG. 8 is a perspective view of yet another, alternative shaft-turning mechanism according to a preferred embodiment of the present invention.

FIG. 8 illustrates in perspective another, alternative embodiment of a the present ATM mover with a chain and sprocket drive for rotating shaft 42. Shaft 42 is coupled to a first sprocket 70 which is in turn connected by a chain 72 to a second sprocket 74. A handle 76 is used to turn second sprocket 74 in the appropriate direction, depending on whether ATM 12 is to be moved to the extended position or the retracted position.

Regardless of the coupling or whether the movement is accomplished manually or electrically, stops 60 (FIG. 3) limit the movement in each direction. If the movement is provided using an electric motor 54, stops 60 can be limit switches rather than interference stops that can be used to turn off motor 54 when carriage 22 has reached the end of its travel.

Carriage 22 rides on and is supported by frame 20. At its front end, carriage 22 is supported by resting on shaft 42. At its back end, it has two arms 62, one depending from each side and carrying a roller bearing 64. The location and disposition of arms 62 is such that each roller bearing 64 engages a side rail 30 in such a way that bearing 64 is prevented from vertical movement by side rail 30. Bearing 64's horizontal movement along rail 30 is not restricted other than by stops 60. Preferably, when side rails 30 are made of channel steel, the open side is to the side (outside or inside of frame 20) so that one side of the channel is up and one is down, like the letter "C". Roller bearings 64 ride inside the channel, engaging the sides of the channel above and below it, and arms 62 depend from carriage 22 on the open side of side rails 30 as shown in FIG. 4.

Central rail 36 is oriented preferably with the open side facing up to receive an arm 66 and a roller bearing 68 from member 34. Any side-to-side motion of ATM 12 is limited by pressure of central rail 36 against bearing 68. Central rail 36, therefore, helps to maintain the alignment of both carriage 22 and ATM 12 as they move between retracted and extended positions.

When carriage 22 is in the retracted position, the weight of an ATM 12 will cause roller bearings 64 to bear against the bottom of side rails 30; when in the extended position, the weight of ATM 12 will cause roller bearings 64 to bear against the top of rails 30. Thus, bearings 64 cooperate with side rails 30 to secure the back end of carriage 22 to frame 20 whether it is in the extended position or the retracted position, but provide significant securement to hold carriage 22 down when carriage 22 and ATM 12 move to the extended position where it is cantilevered over drive-through area 18.

Figure 5:
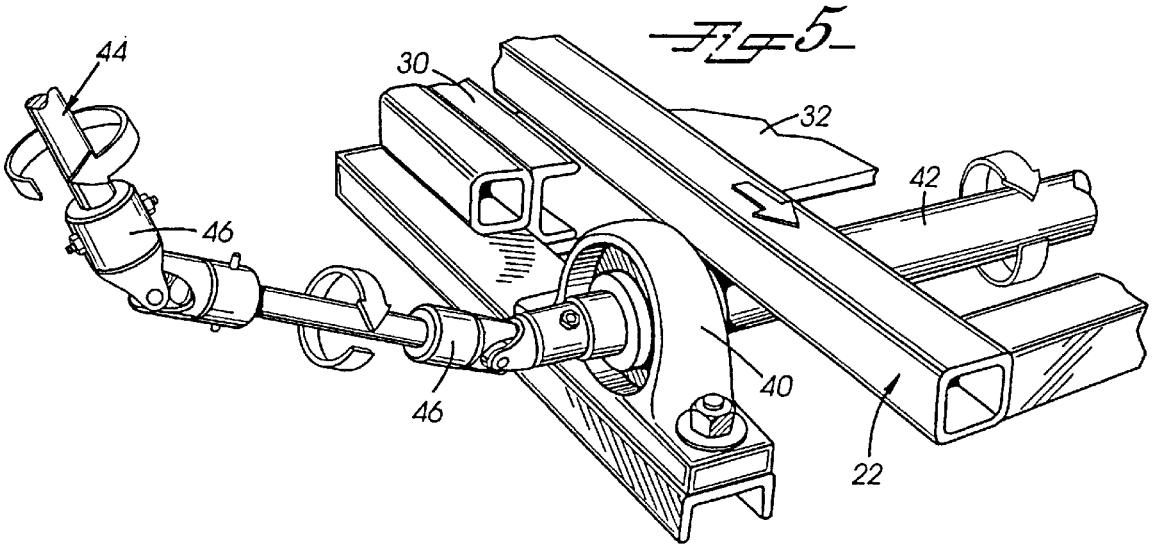
FIG. 5 is a perspective view of the shaft-turning mechanism according to a preferred embodiment of the present invention.

It will be clear that by simply rotating shaft 42 with ATM 12 on carriage 22, using manual or electric means, carriage 22 will move in the direction of rotation, as illustrated in FIGS. 5 and 6. The speed of rotation is arbitrary, and assuming frame 20 is level, the amount of force will depend primarily on the friction of bearings 40 and the diameter of shaft 42.

It will be apparent to those skilled in the art that many changes and substitutions can be made to the preferred embodiment herein described without departing from the spirit and scope of the present invention as defined by the appended claims.

What is claimed:

1. Apparatus for moving an automatic teller machine between a retracted position and an extended position, said apparatus comprising:

a frame having a front end and a back end;

bearings attached to said front end of said frame;

a shaft rotatable in said bearings;

a carriage carried by said frame, said carriage having a front end and back end, said carriage adapted to carry said teller machine, said carriage riding in direct engagement with said shaft between a retracted position wherein said front end of said carriage is substantially coextensive with said front end of said frame, and an extended position wherein said front end of said carriage is cantilevered beyond said front end of said frame;

means carried by said frame for securing said back end of said carriage to said frame when said carriage moves between said retracted and said extended positions, said securing means cooperating with said shaft to cantilever said front end of said carriage beyond said front end of said frame, said carriage being substantially supported by said shaft when said front end is cantilevered; and means for rotating said shaft so that said carriage moves between said retracted position and said extended position.

2. The apparatus as recited in claim 1, wherein said rotating means further comprises:

a hand crank; and means for coupling said hand crank to said shaft.

3. The apparatus as recited in claim 1, wherein said rotating means further comprises:

a motor; and means for coupling said motor to said shaft.

4. The apparatus as recited in claim 1, wherein said frame further comprises at least one rail, and said carriage includes at least one arm having a roller bearing rotatably carried thereon and proximate to said back end of said carriage, said roller bearing engaging a rail of said at least one rail so that when said carriage is in said extended position and is cantilevered beyond said front end of said frame, said rail holds down said roller bearings.

5. The apparatus as recited in claim 1, wherein said frame further comprises a left rail and a spaced apart right rail, and said carriage further comprises two arms, each having a roller bearing rotatably mounted thereon and positioned to engage said left and right rails of said frame, so that when said carriage is in said extended position and is cantilevered beyond said front end of said frame, said left and right rails hold down said roller bearings.

6. The apparatus as recited in claim 4, wherein said rotating means further comprises:

a hand crank; and means for coupling said hand crank to said shaft.

7. Apparatus, comprising:

a teller machine;

a frame having a front end and a back end;

bearings attached to said front end of said frame;

a shaft rotatable in said bearings;

a carriage carried by said frame, said carriage having a front end and back end, said teller machine resting atop said carriage, said carriage riding in direct engagement with said shaft between a retracted position wherein said front end of said carriage is substantially coextensive with said front end of said frame, and an extended position wherein said front end of said carriage is cantilevered beyond said front end of said frame;

means carried by said frame for securing said back end of said carriage to said frame when said carriage moves between said retracted and said extended positions, said securing means cooperating with said shaft to cantilever said front end of said carriage beyond said front end of said frame, said carriage being substantially supported by said shaft when said front end is cantilevered; and means for rotating said shaft so that said carriage moves between said retracted position and said extended position.

8. The apparatus as recited in claim 7, wherein said rotating means further comprises:

a hand crank; and means for coupling said hand crank to said shaft.

9. The apparatus as recited in claim 7, wherein said rotating means further comprises:

a motor; and means for coupling said motor to said shaft.

10. The apparatus as recited in claim 7, wherein said frame further comprises at least one rail, and said carriage includes at least one arm having a roller bearing rotatably carried thereon and proximate to said back end of said carriage, said roller bearing engaging said a rail of said at least one rail so that when said carriage is in said extended position and is cantilevered beyond said front end of said frame, said rail holds down said roller bearings.

11. The apparatus as recited in claim 7, wherein said frame further comprises a left rail and a spaced apart right rail, and said carriage further comprises two arms, each having a roller bearing rotatably mounted thereon and positioned to engage said left and right rails of said frame, so that when said carriage is in said extended position and is cantilevered beyond said front end of said frame, said left and right rails hold down said roller bearings.

12. The apparatus as recited in claim 7, wherein said rotating means further comprises:

a hand crank; and means for coupling said hand crank to said shaft.

13. The apparatus as recited in claim 7, further comprising a first stop carried by said frame, limiting movement of said carriage with respect to said rail at said retracted position, and a second stop carried by said frame, limiting movement of said carriage with respect to said rail at said extended position.

14. A kiosk for housing an automatic teller machine, said kiosk comprising:

a housing having an opening dimensioned to allow an automatic teller machine to be moved therethrough;

a frame in said housing and having a front end and a back end;

bearings attached to said front end of said frame;

a shaft rotatable in said bearings;

a carriage carried by said frame, said carriage having a front end and back end, said carriage adapted to carry said teller machine, said carriage riding in direct engagement with said shaft between a retracted position wherein said front end of said carriage is substantially within said housing, and an extended position wherein said front end of said carriage is cantilevered beyond said front end of said frame and through said opening in said housing;

means carried by said frame for securing said back end of said carriage to said frame when said carriage moves between said retracted and said extended positions, said securing means cooperating with said shaft to cantilever said front end of said carriage beyond said front end of said frame, said carriage being substantially supported by said shaft when said front end is cantilevered; and means for rotating said shaft so that said carriage moves between said retracted position and said extended position.

15. The apparatus as recited in claim 14, wherein said rotating means further comprises:

a hand crank; and means for coupling said hand crank to said shaft.

16. The apparatus as recited in claim 14, wherein said rotating means further comprises:

a motor; and means for coupling said motor to said shaft.

17. The apparatus as recited in claim 14, wherein said frame further comprises at least one rail, and said carriage includes at least one arm having a roller bearing rotatably carried thereon and proximate to said back end of said carriage, said roller bearing engaging said a rail of said at least one rail so that when said carriage is in said extended position and is cantilevered beyond said front end of said frame, said rail holds down said roller bearings.

18. The apparatus as recited in claim 14, wherein said frame further comprises a left rail and a spaced apart right rail, and said carriage further comprises two arms, each having a roller bearing rotatably mounted thereon and positioned to engage said left and right rails of said frame, so that when said carriage is in said extended position and is cantilevered beyond said front end of said frame, said left and right rails hold down said roller bearings.

19. The apparatus as recited in claim 14, wherein said rotating means further comprises:

a hand crank; and means for coupling said hand crank to said shaft.

20. The apparatus as recited in claim 14, further comprising a first stop carried by said frame, limiting movement of said carriage with respect to said rail at said retracted position, and a second stop carried by said frame, limiting movement of said carriage with respect to said rail at said extended position.

* * * * *